US005603769A

United States Patent [19]

Okubo et al.

[11] Patent Number: 5,603,769

[45] Date of Patent: Feb. 18, 1997

[54] CONVEYOR DEVICE

[75] Inventors: Masaru Okubo; Shinichi Nakane; Hitoshi Yano; Noriyuki Achiwa; Sigeki Fujiwara, all of Toyota, Japan

[73] Assignee: Trinity Industrial Corporation, Tokyo, Japan

[21] Appl. No.: 329,853

[22] Filed: Oct. 27, 1994

[30] Foreign Application Priority Data

Apr. 1, 1994 [JP] Japan ..... 6-064261

[51] Int. Cl.[6] ..... B05C 5/02

[52] U.S. Cl. ..... 118/621; 118/623; 118/630; 118/635

[58] Field of Search ..... 118/621, 623, 118/625, 635, 630, 638, 640; 427/458, 482, 508, 549, 551, 553, 591, 543; 198/465.1, 465.3; 219/388; 361/225, 227

[56] References Cited

U.S. PATENT DOCUMENTS

| | | | |
|---|---|---|---|
| 3,875,892 | 4/1975 | Gregg et al. | 118/665 |
| 5,190,588 | 3/1993 | Matsushita et al. | 118/635 |
| 5,234,156 | 8/1993 | Ribnitz | 118/622 |
| 5,325,601 | 7/1994 | Brownewell et al. | 118/643 |

FOREIGN PATENT DOCUMENTS

| | | |
|---|---|---|
| 55-114366 | 9/1980 | Japan . |
| 56-41869 | 11/1981 | Japan . |
| 3224651 | 10/1991 | Japan . |
| 3105948 | 11/1991 | Japan . |
| 461944 | 2/1992 | Japan . |
| 4036483 | 2/1992 | Japan . |
| 416796 | 2/1992 | Japan . |
| 4225857 | 8/1992 | Japan . |

*Primary Examiner*—Donald E. Czaja
*Assistant Examiner*—Calvin Padgett
*Attorney, Agent, or Firm*—Cushman Darby & Cushman IP Group of Pillsbury Madison & Sutro LLP

[57] ABSTRACT

A conveyor device for applying a high voltage to a work transported in a coating booth includes a conveyor device main body having a running base running in the coating booth and an electrode attachment attached to the running base being insulated therefrom for carrying the work and applying a high voltage to the work, an electromagnetic wave transmitter disposed in the coating booth for transmitting electromagnetic waves to the running base during running in a high voltage application zone and a low voltage generator means for receiving electromagnetic waves from the electromagnetic transmitter means and a high voltage generator for stepping-up a low voltage outputted from the low voltage generator and supplying a high voltage to the electrode attachment, mounted on the running base.

6 Claims, 7 Drawing Sheets

CONVEYOR DEVICE

BACKGROUND OF THE INVENTION

1. Field of the Invention

The present invention concerns a conveyor device used for electrostatic coating by applying a high voltage on a work to be coated instead of applying the high voltage on a coating machine.

2. Description of the Prior Art

Electrostatic coating of a work such as a car body has been conducted so far by applying a high voltage of from −80 V to 120 kV on an electrostatic coating machine that jets out paint while to the earth grounding a work placed on a conveyor truck.

In this case, electrostatic coating is generally applied by using an insulative paint. Movements for environmental protection have become popular world wide in recent years and it has been keenly advocated to regulate the use of organic solvents such as hydrocarbons that yield substances causing public pollution and, in compliance therewith, it has been recommended also in the industrial field of coating to cease the use of insulative paints that consume a great amount of deleterious organic solvents such as thinner and transfer to electrostatic coating using aqueous paints causing no public pollution.

However, when an electroconductive paint such as an aqueous paint is sprayed by an electrostatic coating machine applied with a high voltage, it is necessary to provide an adequate means for the insulation of a paint supply system so as not to leak a high voltage applied to the coating machine (refer to Japanese Patent Laid Open Sho 55-114366 and Sho 56-141869). This results in considerable troubles to a coating facility of car bodies for conducting multi-color coating while changing colors of paints among several tens of colors, in that each of the paint supply pipelines and paint reservoirs has to be insulated.

In addition, it is also necessary to provide a safety means for the paint supply system applied with the high voltage, such as by surrounding the periphery of the paint supply pipe lines or paint reservoirs with protection chambers, but this results in a problem of remarkably increasing the cost for insulation and safety and enlarging the scale of the entire facility.

In view of the above, the applicant has already proposed a conveyor device capable of applying a high voltage on a work so that electrostatic coating can be conducted using an electroconductive paint without providing insulation means for the paint supply system (Japanese Utility Model Laid-Open Hei 3-105948 and Hei 4-16796).

FIG. 10 illustrates such a proposed conveyor device, in which a work W is placed on a truck 71 running on a rail 70, and an electrode attachment 72 for applying a high voltage to the work is attached in an insulated state by means of insulation posts 73, such as ones made of porcelain, for keeping a necessary insulation distance. A current collector rail 74 is disposed along a transporting direction of the truck 71 in a high voltage application zone for conducting electrostatic coating under application of a high voltage to the work, and a contact 75 connected to the attachment 72 is in sliding contact with the collector rail 74.

When the truck 71 comes to the high voltage coating zone, the contact 75 is brought into sliding contact with the collector rail 74 to apply the high voltage on the work W, so that electrostatic coating can be conducted without providing insulation means to the electrostatic coating machine, the paint supply system, the floor conveyor or the like.

However, since the high voltage is always supplied to the collector rail 75, sparks are generated on every instance of contact and detachment between the contact 74 of the truck 71 and the collector rail 75, as well as during sliding contact between the contact 74 and the collector rail 75 caused by attachment and detachment between them.

If sparks are generated, surfaces of the contact 74 and the collector rail 75 are melted and made uneven by the heat, which tends to cause more sparks. This enforces frequent exchange of the contact 74 and the collector rail 75 to bring about a problem of increasing the maintenance cost.

In addition, since there is a great potential difference between the collector rail 75 and the coating machine, an electrostatic field is formed between them to cause the paint liable to deposit on the collector rail 75, so that the rail has to be cleaned frequently and this brings about considerable troubles in the maintenance.

For overcoming such problems, it has been proposed to dispose the collector rail in a groove filled with an insulating oil for covering the surface of the collector rail with the insulating oil to thereby prevent the generation of sparks or prevent the formation of the electrostatic field (refer to Japanese Patent Laid-Open Hei 4-61944).

However, the insulating oil, if it is used in the coating zone, would splash and deposit on the work, which repels the paint and brings about a problem of defective coating.

Further, it has also been proposed to once transfer a work to an insulated conveyor disposed in a high voltage application zone and then apply a high voltage (refer to Japanese Patent Laid-Open Hei 3-224651 and Hei-44-225857).

However, this complicates and enlarges the scale of the facility and requires provision of voltage increasing and decreasing zones before and after transfer steps so that sparks may not be generated upon transfer to the insulated conveyor, which results in a problem of troublesome voltage control and requiring a large space.

OBJECT OF THE INVENTION

In view of the above, it is a technical subject of the present invention to provide a device capable of reliably applying a high voltage by way of an electrode attachment on a work, without using a current collector rail or a contact, with no particular voltage control and free from the worry of generating of sparks during running of a running base that carries the work in a high voltage application zone.

SUMMARY OF THE INVENTION

The foregoing object can be attained in accordance with the present invention by a conveyor device for applying a high voltage to a work transported along a predetermined track during transportation in a high voltage application zone formed in a coating booth, wherein a conveyor device main body comprises a running base running along a predetermined track formed in the coating booth and an electrode attachment attached to the running base in an insulated state for carrying a work and applying a high voltage thereto, an electromagnetic wave transmission means is disposed in the coating booth for transmitting electromagnetic waves to the running base during running of the running base in the high voltage application zone in which electrostatic coating is carried out by applying a high voltage to the work, and the running base has, provided therewith, a low voltage generation means for receiving electromagnetic waves transmitted from the electromagnetic transmission means in a contactless fashion and outputting a low voltage, and has, provided therewith, a high voltage generation means for stepping up a low voltage outputted from the low voltage generation means to a predetermined voltage and supplying a high voltage to the electrode attachment.

In accordance with the present invention, when a running base reaches a high voltage application zone, electromagnetic waves are transmitted from an electromagnetic wave transmission means disposed in a coating booth to the running base, and a low voltage generation means disposed in the running base outputs a low voltage.

For instance, the electromagnetic wave transmission means used comprises an induction rail laid in a high voltage application zone and constituting a primary circuit for electromagnetic induction, and the low voltage generation means used comprises pick-up coils that constituting a secondary circuit for electromagnetic induction. Then, if the pick-up coils are disposed to the running base so as to oppose in a contactless fashion to the induction rail, a low voltage is supplied only while both of them oppose to each other, namely, only during transportation of the work in the high voltage application zone and the low voltage is inputted to a high voltage generation means mounted on the running base and then stepped up, with no requirement for the ON-OFF control of the voltage.

Since the electromagnetic waves are thus supplied in the contactless fashion and, in addition, it can be supplied from such a low energy source as capable of outputting a low voltage, a high voltage is applied by way of an electrode attachment to the work, without generating sparks, also upon transportation of the running base into and out of the high voltage application zone.

BRIEF DESCRIPTION OF THE ACCOMPANYING DRAWINGS

These and other features and advantages of the present invention will be apparent from the following description taken in connection with the accompanying drawings wherein.

DESCRIPTION OF THE PREFERRED EMBODIMENTS

Figure 1:
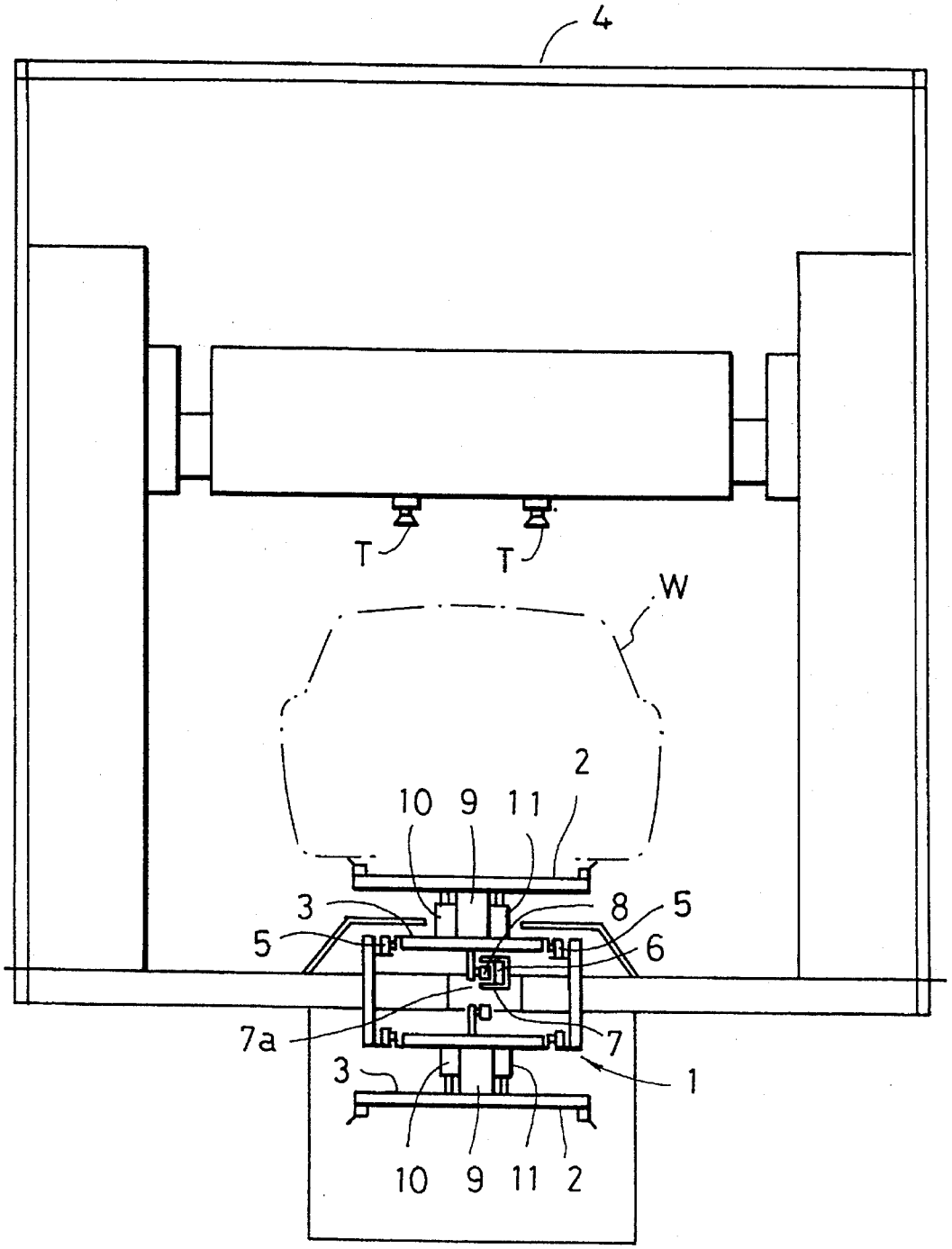
FIG. 1 is a front elevational view illustrating a coating booth in which a conveyor device according to the present invention is disposed.

Description will be made more specifically to the present invention by way of preferred embodiments shown in the drawings.

Figure 2:
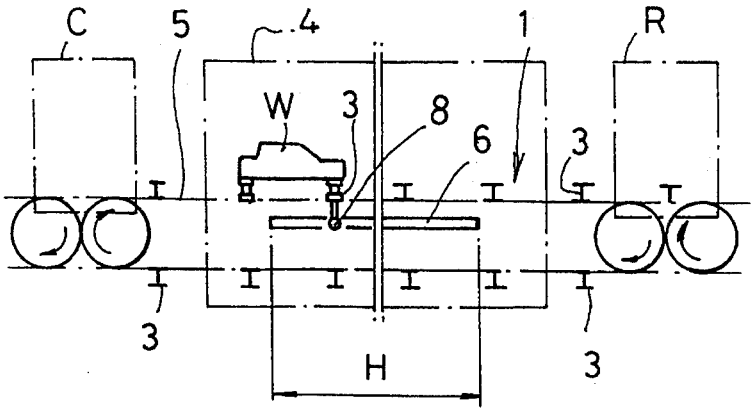
FIG. 2 is a side elevational view of the coating booth.

FIG. 1 is a front elevational view illustrating a coating booth in which a conveyor device according to the present invention is disposed and FIG. 2 is a side elevational view of the coating booth.

In a conveyor device main body 1, a plurality of slats (running bases) 3 each having an electrode attachment 2 mounted thereon for applying a high voltage on a work W mounted on the running base are disposed each at a predetermined distance to an endless chain 5 that runs between a loading device C and a relay device R disposed before and after a coating booth 4 (FIG. 2).

In the coating booth 4, a high voltage application zone H is formed in which electrostatic coating is carried out in a state of applying a high voltage on the work W. In the high voltage application zone H, a coating machine T grounded to the earth is disposed so that it can track along a transporting direction of the slat 3, and an induction rail (electromagnetic wave transmission means) 6 constituting a primary circuit for electromagnetic induction is disposed for a predetermined length along the transporting direction of the work W.

The induction rail 6 is disposed so as to situate, for example, below the slat 3 running in the coating booth 4, and covered with a cover 7 having a longitudinal slit 7*a*.

Pick-up coils (low voltage generation means) 8 constituting a secondary circuit for electromagnetic introduction are attached to the slat 8 at a position opposing to the induction rail 6, and the pick-up coils 8 are so adapted to oppose the induction rail 6 in the contactless fashion in a state being inserted through the slit 7*a* when the slat 3 runs in the high voltage application H.

Further, an insulation post 9 is disposed vertically to each of the slats 3 for supporting the electrode attachment 2 in the insulated state and a small-sized high voltage generator 10 and a high resistance circuit 11 are disposed on both right and left sides of the insulation post 9.

The high voltage generator 10 is adapted to step-up an induced electromotive force outputted from the pick-up coils 8 as a primary power source, supply a high voltage to the electrode attachment 2 and apply the high voltage to the work W. Further, the high resistance circuit 11 serves to remove static electric charges remaining on the work W and the electrode attachment 2 after the slat 3 has passed the high voltage application zone H and application of the high voltage to the work W has been completed. The resistance value of the circuit 11 is selected, for example, as from several thousands to ten thousand MXX for preventing short-circuit during application of the high voltage. Instead of the high resistance circuit 11, a grounding switch may be disposed for connecting the electrode attachment 2 to the earth when a certain alarm signal is inputted.

Description will be made to the operation of the embodiment of the present invention having the constitution described above.

At first, an AC current at a low voltage (for example, about 300 to 500 V) is supplied to the induction rail 6 and the movement of the conveyor device main body 1 is started. The work W is placed on the slat 3 by a loading device C disposed before the coating booth 4 and then transported into the coating booth 4.

Then, when the slat 3 carrying the work W comes to the high voltage application zone H, the pick-up coils 8 attached to the slat 3 are inserted through the slit 8*a* in the cover 7 and moved while being opposed to the induction rail 6 in a contactless fashion.

Since the AC current at a predetermined voltage is supplied to the induction rail 6, an electromotive force is induced to the pick-up coils 8 by electromagnetic induction, and supplied to the high voltage generator 10 mounted on the slat 3.

Since the high voltage generator 10 is adapted to step-up the induced electromotive force as a primary power source and, finally, supply a high DC voltage to the electrode attachment 2, the high voltage is applied by way of the electrode attachment 2 to the work W and electrostatic coating can be carried out by merely atomizing a paint from the coating machine T grounded to the earth.

Then, after the slat 3 has passed the high voltage application zone H, since the induction rail 6 opposed to the pick-up coils 8 in the contactless fashion is no more present, the electromotive force is induced no more and, accordingly, application of the high voltage to the work W is automatically stopped. Then, the work is unloaded from the slat 3 by the relay device R and then transferred to a succeeding baking/drying step.

Since static charges remaining on the work W and the electrode attachment 2 are removed by way of the high resistance circuit 11 to the earth, no static charges are accumulated on the slat 3.

Namely, the high voltage is applied on the work W only while the work W runs in the high voltage application zone, and the static charges have been removed already upon transfer of the work W to the next conveyor by the relay device R, to ensure operation safety.

The high resistance circuit 11 is grounded to the earth also during running of the slats 3 in the high voltage application zone H and during application of the high voltage on the work, so that the charges at high voltage applied on the work slightly escape to the earth but the high resistance value of the circuit 11 can prevent flow of overcurrent or short-circuit.

As described above, according to this embodiment, since the primary source for the high voltage generator is supplied in the contactless fashion during running of the slat 3 in the high voltage application zone H, the high voltage applied on the work W can automatically be supplied/stopped with no ON-OFF circuit operation at all.

In addition, since it is suffice to supply, to the induction rail 6, such a low power as capable of inducing necessary electromotive force to the pick-up coils 8 by electromagnetic induction as the primary source for the high voltage generator 10, no intense static field is formed between the coating machine T and the induction rail 6, so that the paint does not electrostatically deposit on the induction rail 6.

Figure 3:
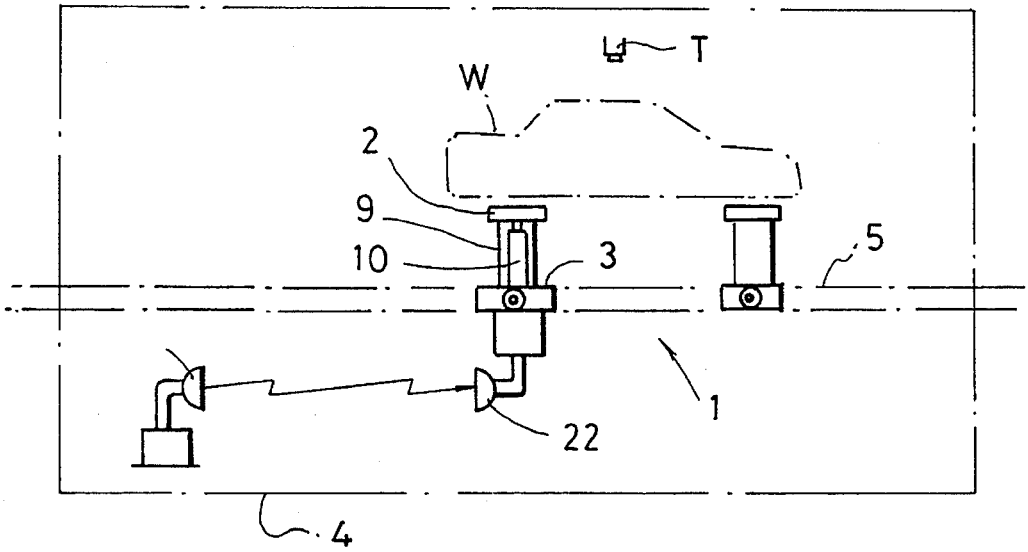
FIG. 3 is a side elevational view illustrating another conveyor device according to the present invention.
Figure 4:
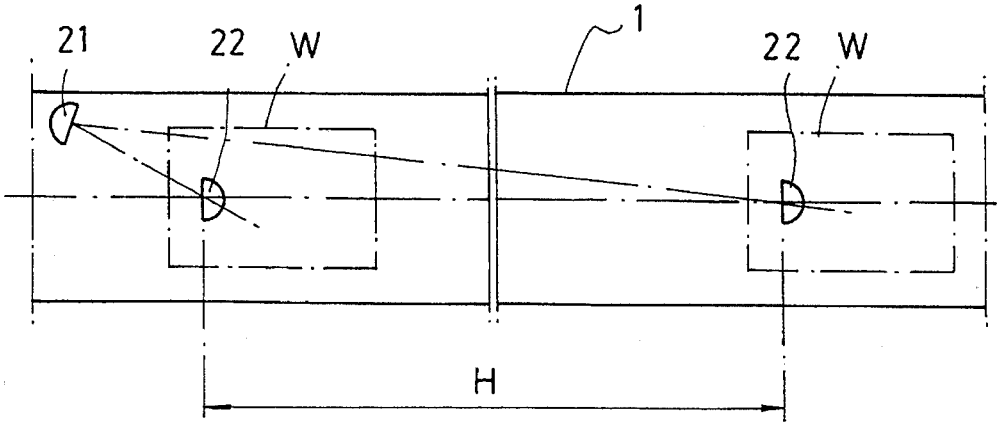
FIG. 4 is a plan view of the conveyor device.

FIG. 3 is a side elevational view illustrating another conveyor device according to the present invention and FIG. 4 is a plan view thereof. Portions and components in FIG. 4 identical with those shown in FIGS. 1 and 2 carry the same reference numerals, for which detailed descriptions will be omitted.

In this embodiment, a microwave transmission system is adopted instead of supplying the primary power source to the high voltage generator 10 by the electromagnetic induction system as in the previous embodiment.

A microwave transmission antenna (electromagnetic wave transmission means) 21 is disposed in a coating booth 4 for transmitting microwaves to a slat 3 running in a high voltage application zone H.

Each slat 3 is provided with a microwave receiving antenna 22 that opposes the microwave transmission antenna 21, and it is so adapted that a voltage outputted from the receiving antenna (low voltage generation means) 22 is supplied to a high voltage generator 10.

The microwave transmission antenna 21 is adapted, for example, as shown in FIG. 4 such that it transmits microwaves for a predetermined range of irradiation angle which is enough to cover a moving distance of the microwave receiving antenna 22 from the entrance to the exit of the slat 3 for the high voltage application zone H, so that the microwave receiving antenna 22 can receive the microwaves throughout this distance.

Further, a voltage outputted from the microwave receiving antenna 22 is converted into a DC or AC current at a predetermined voltage, and a high voltage generator 10 steps-up the same as a primary power source, supplies a high DC voltage to the electrode attachment 2 and applies a high voltage to the work W placed on the attachment 2.

When the movement of the conveyor device main body 1 is started under transmission of microwaves for the predetermined range of irradiation angle from the microwave transmission antenna 21, the microwaves outputted from the microwave transmission antenna 21 are received by the microwave receiving antenna 22 disposed on the slat 3 carrying the work W from the entrance till the exit of the slat 3 of the high voltage application zone H.

During reception of the microwaves, the received microwaves are converted into a DC or AC current at a predetermined voltage, and supplied to the high voltage generator 10.

Since the high voltage generator 10 is adapted to step-up the thus induced electromotive force as the primary power source and supply a high voltage to the electrode attachment 2, a high voltage is applied by way of the electrode attachment 2 to the work W, and electrostatic coating can be applied by merely atomizing a paint from the coating machine T grounded to the earth.

Then, after the slat 3 has passed the high voltage application zone H, since the microwaves are emitted no more to the microwave receiving antenna 22, application of the high voltage on the work W is stopped.

As has been described above, also in this embodiment, since the primary power source for the high voltage generator is supplied in a contactless fashion only during running of the slat 3 in the high voltage application zone H, the high voltage applied to the work W can be automatically supplied/stopped with no circuit ON-OFF generation at all.

Figure 5:
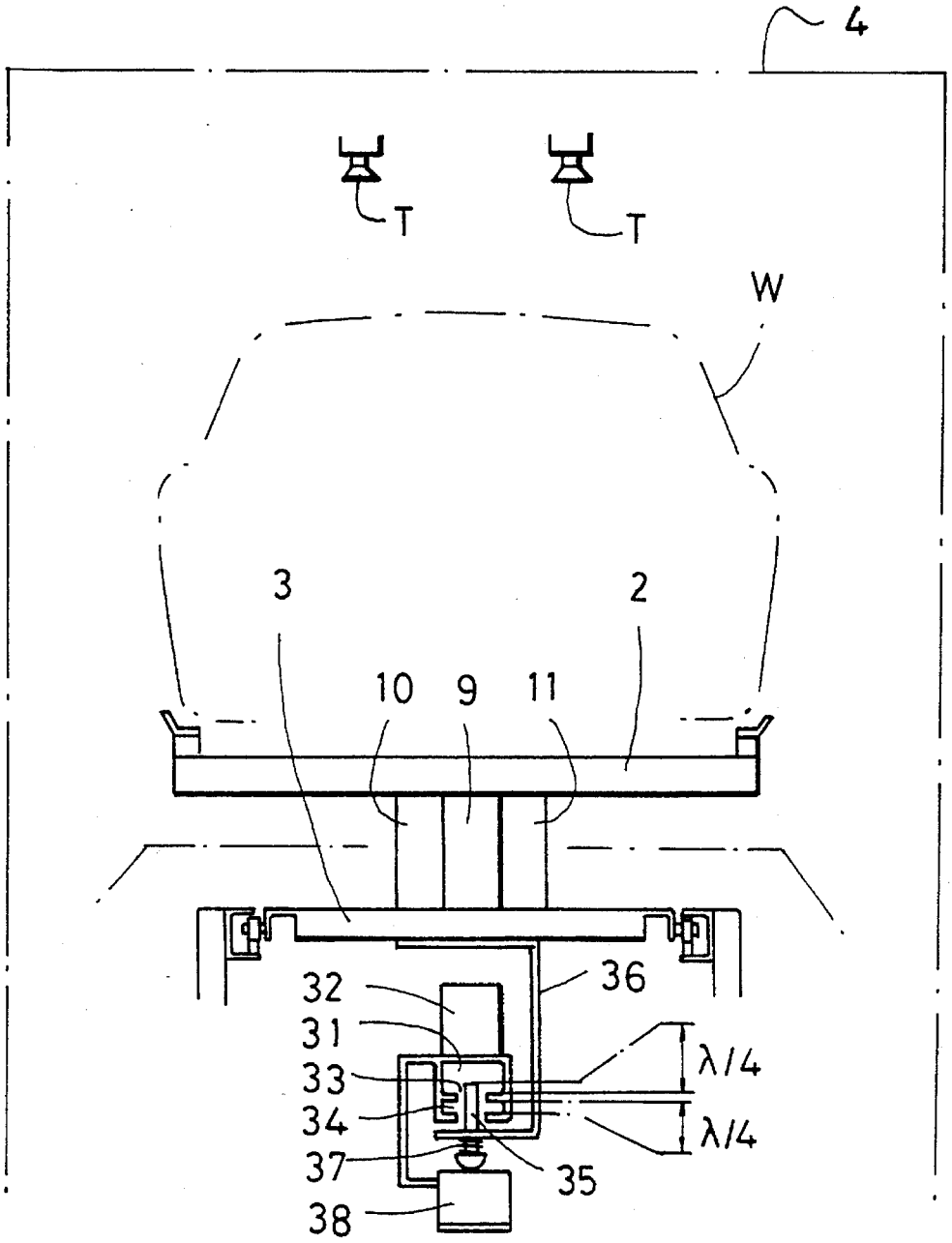
FIG. 5 is a front elevational view illustrating another conveyor device according to the present invention.
Figure 6:
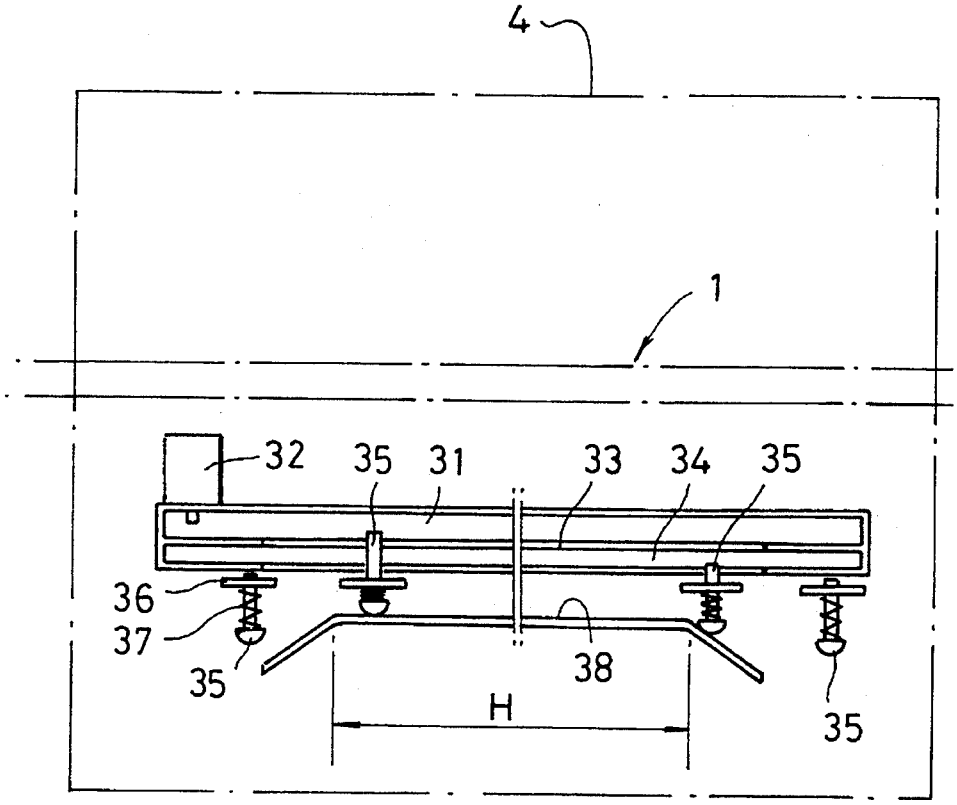
FIG. 6 is a side elevational view of the conveyor device.

FIG. 5 is a front elevational view illustrating a further conveyor device according to the present invention and FIG. 6 is a side elevational view thereof. Portions or components in FIG. 5 identical with those in FIGS. 1 and 2 carry the same reference numerals, for which detailed explanations will be omitted.

In this embodiment, microwaves are guided to a waveguide tube for supplying a primary power source.

In a high voltage application zone H in a coating booth 4, a waveguide tube (electromagnetic wave transmission means) 31 of a predetermined length is disposed along the transporting direction of a work W.

The waveguide tube 31 situates, for example, below a slat 3 running in the coating booth 4 and has a magnetron 32 attached at one end for oscillating microwaves.

Further, the waveguide tube 31 has a cross section of a large width in which a slit 33 is opened with a width less than one-half wavelength in the longitudinal direction along the center line of the bottom, and a phase transducer 34 having ¼ wavelength depth is disposed to the opening of the slit 33 for preventing leakage of microwaves.

On the other hand, a microwave receiving antenna 35 is disposed vertically movably to the top end of a bracket 36 on the slat 3 such that the antenna is inserted within the slit 33 of the waveguide tube 31 in a contactless fashion.

The microwave receiving antenna 35 is so adapted that it is resiliently biased downwardly by a spring 37 and inserted by the ¼ wavelength into the slit 33 being urged at the lower end of the antenna by a guide rail 38 disposed below the waveguide tube 31.

Then, microwaves received by the microwave receiving antenna 35 are converted into a DC or AC current at a predetermined voltage, and supplied to and stepped-up by a high voltage generator 10.

Since the high voltage generator 10 is adapted to supply a high DC voltage finally to an electrode attachment 2, the high voltage is applied by way of the electrode attachment 2 on the work W and electrostatic coating can be carried out by merely atomizing a paint from a coating machine T grounded to the earth.

Then, in this embodiment, movement of the conveyor device 1 is started in a state in which the magnetron 32 is actuated to supply the microwaves in the waveguide tube 31.

In this embodiment, since the slit 32 of the waveguide tube 31 is formed on the center line at a wide bottom, the width of the slit is selected to less than one-half wavelength, and since the phase transducer 34 is disposed, the microwaves are not leaked from the slit 32.

Then, when the slat 3 comes to the high voltage application zone H, the lower end of the microwave receiving antenna 35 is raised by the guide rail 38 against the resiliency of a spring 37 and the top end is inserted into the waveguide tube 31.

Thus, the microwaves transmitting in the waveguide tube 31 are received, converted into a DC or AC current at a predetermined voltage and supplied as a primary power source for the high voltage generator 10.

Then, a high voltage is supplied from the high voltage generator 10 to the electrode attachment 2, and the high voltage is applied on the work W, and electrostatic coating can be carried out by merely atomizing a paint from the coating device grounded to the earth (not illustrated).

Then, after the slat 3 has passed the high voltage application zone H, the microwave receiving antenna 35 is withdrawn from the waveguide tube 31 by the resiliency of the spring 37 and the microwaves can no more be received, so that application of the high voltage on the work W is stopped.

As described previously, since the primary power source for the high voltage generator is supplied in the contactless fashion only during running of the slat 3 in the high voltage application zone H also in this embodiment, the high voltage applied to the work W can be automatically supplied/stopped with no circuit ON-OFF operation at all.

Further, since the microwaves are transmitted by way of the waveguide tube 31, they do not leak to the outside of the waveguide tube 31 to ensure high safety, as well as the high voltage can be turned ON and OFF at an accurate timing by the insertion and withdrawal of the antenna 35.

Although the microwave receiving antenna 35 is inserted and withdrawn by inserting and retracting it into and out of the slit 33 in this embodiment, the invention is not restricted only to such a constitution but the microwave receiving antenna 35 may be fixed and the antenna 35 may be introduced from both end faces of the waveguide tube 31 through slits formed on both end faces of the waveguide tube 31 in contiguous with the slit 33.

Furthermore, descriptions have been made to each of the foregoing embodiments to the exemplified slat conveyor in which the slat 3 is attached to the endless chain 5 for the conveyor device main body 1, but the invention is not restricted only thereto but may be embodied, for example, such that a truck is caused to run on a rail looped in a predetermined layout on the floor or a truck may be reciprocated along a linear rail.

Figure 7:
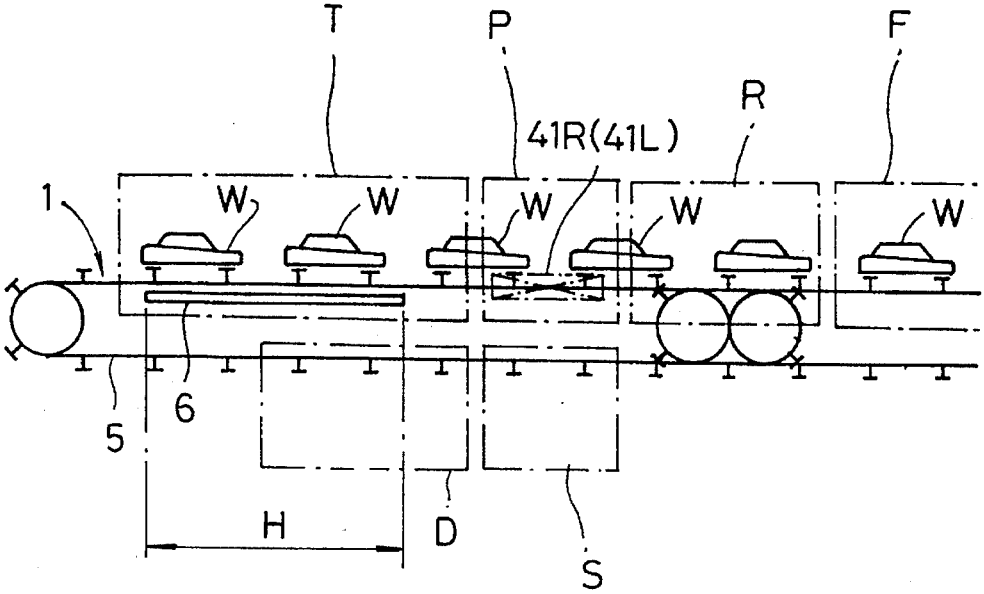
FIG. 7 is a side elevational view illustrating a further conveyor device according to the present invention.
Figure 8:
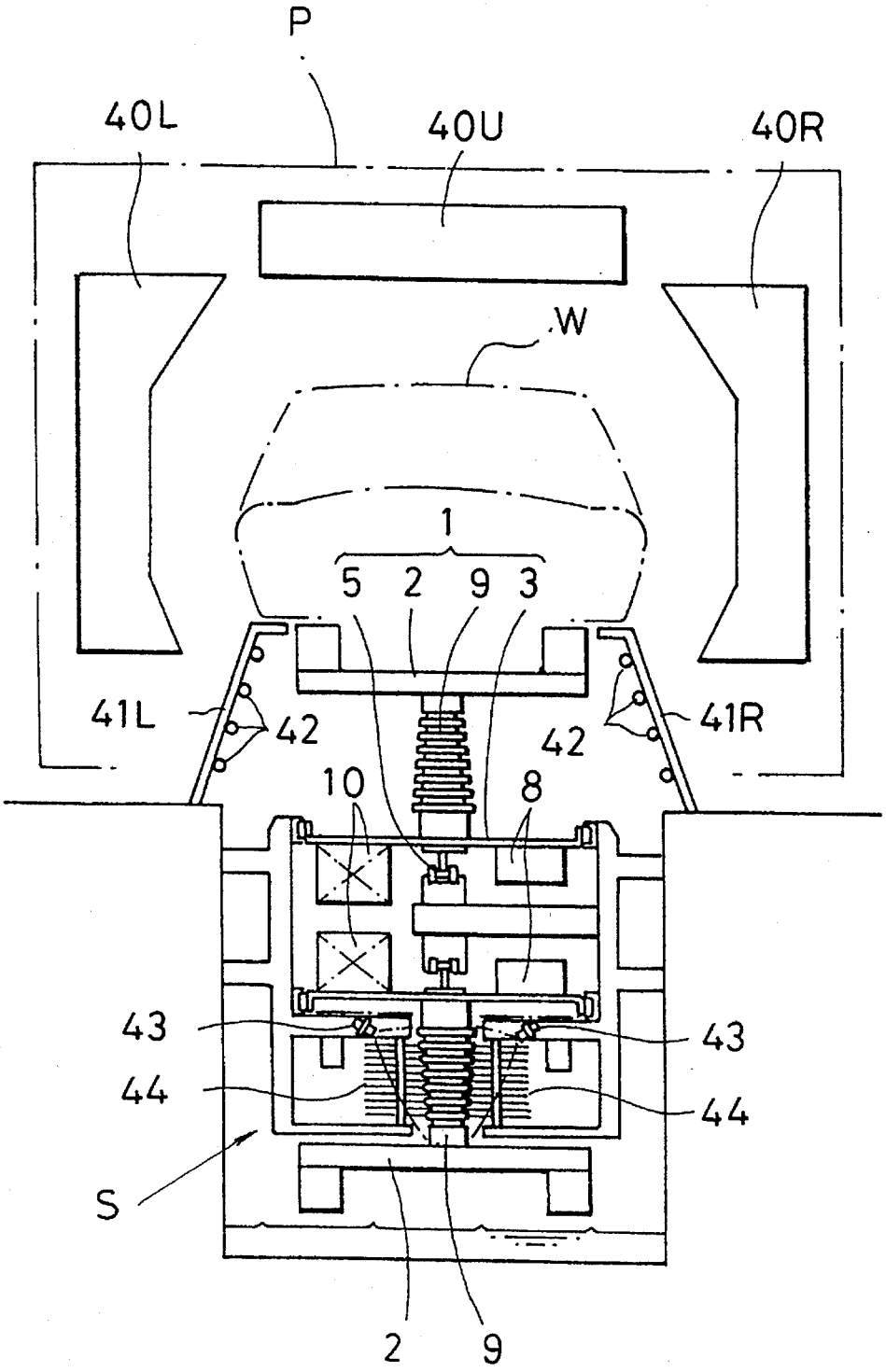
FIG. 8 is a front elevational view illustrating a main portion of the conveyor device shown in FIG. 7.
Figure 9:
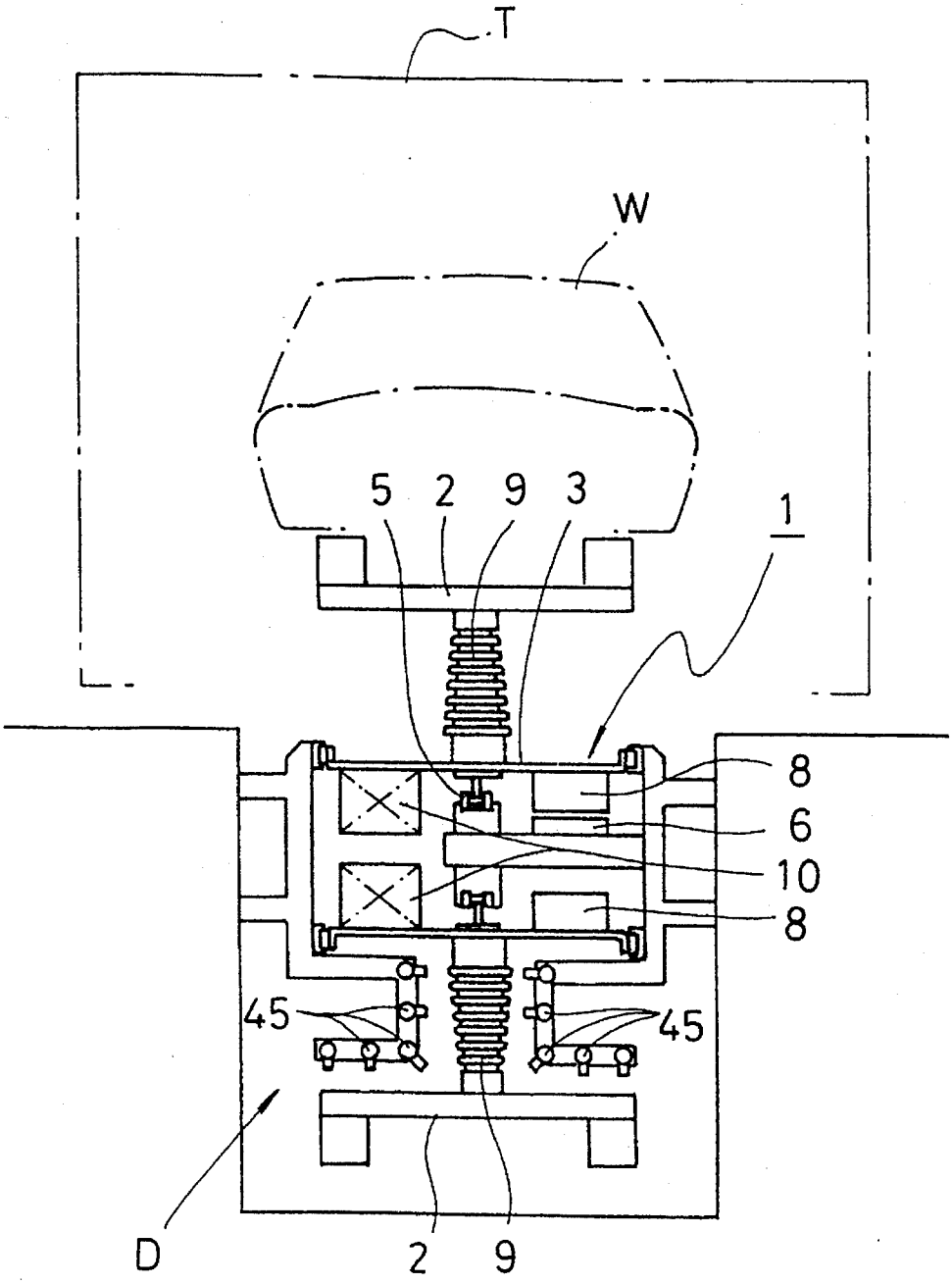
FIG. 9 is a front elevation view illustrating another portion of the conveyor device shown in FIG. 7.
Figure 10:
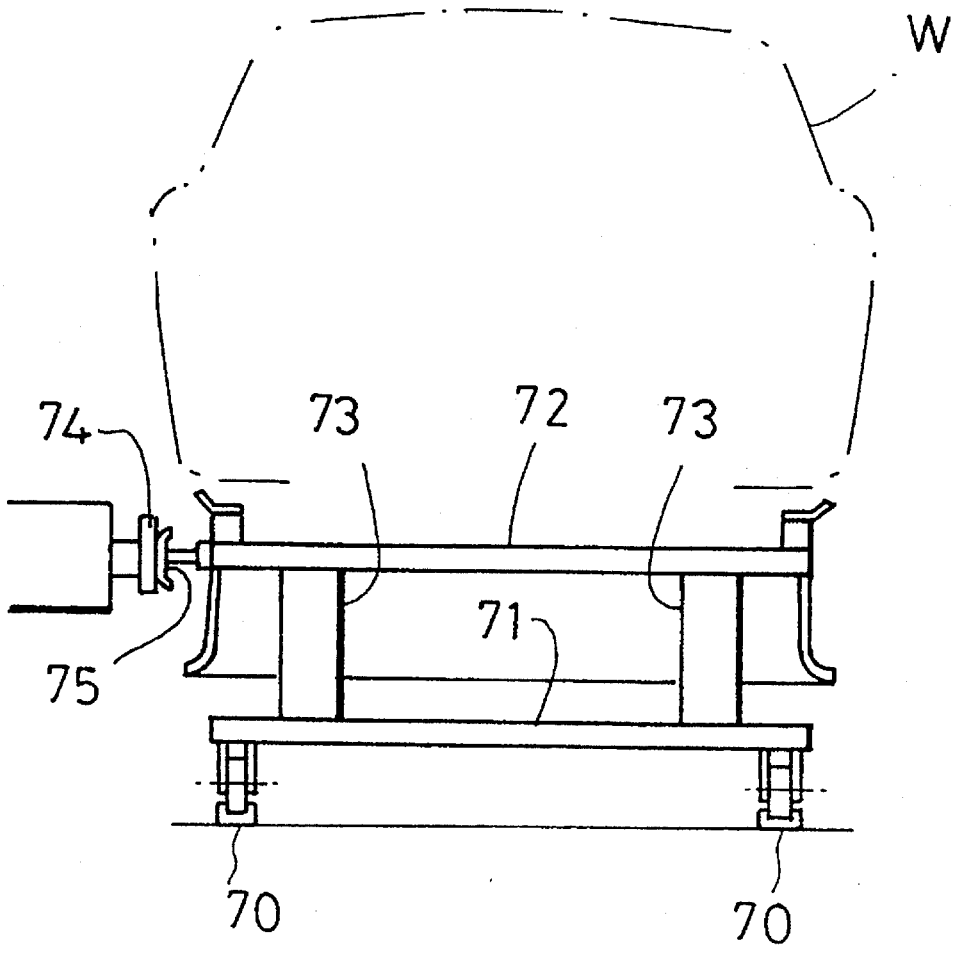
FIG. 10 (PRIOR ART)
FIG. 10 is a front elevational view illustrating a prior art device.

FIG. 7 is a side elevational view illustrating a further conveyor device and each of FIG. 8 and FIG. 9 illustrates a main portion thereof. Portions or components in FIG. 7 identical with those in FIG. 1 and FIG. 2 carry the same reference numerals, For which detailed explanations will be omitted.

In this embodiment, a preheat zone for heating a work to a predetermined temperature is provided so that excessive water content in coating membranes is eliminated as soon as possible after completion of the coating and before entry to a baking/drying furnace. If a work completed with coating is directly entered and heated rapidly in the baking/drying furnace at a high temperature, (for example, about 140° C.), the excessive water content in the coating membranes is evaporated and bubbles are formed to the surface of the coating membranes to cause defective coating and the provision of the preheat zone can prevent such disadvantage.

The conveyor device main body 1 comprises a slat conveyor in which an electrode attachment 2 for carrying works W and applying a high voltage thereon is attached each at a predetermined distance by way of an insulation post 9 to slat, 3 which are caused to run by an endless chain 5.

The endless chain 5 is adapted to advance above the floor of a coating zone T, run through the coating zone T and a preheat zone P and then retract to a level below the floor before a baking/drying furnace F in adjacent with the preheat zone P.

Further, the slat 3 has pick-up coils 8 disposed thereon for opposing, in a contactless fashion, to an induction rail 6 disposed in the coating zone T, and has a high voltage generator 10 mounted thereon for stepping-up an electromotive force induced by pick-up coils 8 to a predetermined high voltage, so that a high voltage is applied by the high voltage generator 10 to the electrode attachment 2.

In this embodiment, the pick-up coils 8 and the high voltage generator 10 are disposed at the rear face of the slat 3 for the sake of the cleaning performance of the slat conveyor 2.

In the preheat zone P, radiation panels (radiation heaters) 40R, 40L, 40U having a plurality of infrared lamps arranged thereon are disposed along three sides, i.e., right and left side walls and ceiling walls such that they oppose to the right and left sides and the upper side of the work W transported by the conveyor device main body 1. Further, heat shield plates 41R, 41L are disposed between the conveyor device main body 1 and the radiation panels 40R, 40L disposed on both right and left sides of the main body 1 for shielding heat radiated from each of the panels 40R, 40L to the conveyor device main body 1.

As shown in FIG. 8, each of the heat shield plates 41R, 41L is made of a metal plate formed so as to cover the portion of the conveyor device main body 1 exposed above the floor and, more specifically, the plate is disposed vertically from both of the right and left sides of the slat 3 running above the floor to a height about at the upper end of the electrode attachment 2, and the top ends of the plates are inwardly bent horizontally so as to oppose to both of the right and left ends at the upper end of the electrode attachment 2.

Further, if the rear faces of the heat shield plates 41R, 41L are heated to a high temperature, the conveyor device main body 1 is heated by the heat emitted from the heat shield plates 41R, 41L. Therefore, the heat shield plates 41R, 41L are made, for example, of metal plates having a heat insulator sandwiched between, or cooling pipes 42 are attached therealong for circulately supplying cooling water as required.

Further, below the floor of the coating zone T and the preheat zone P, are provided a cleaning zone S for cleaning to remove a paint deposited in the coating zone T and a drying zone T for drying.

In the cleaning zone S, are provided shower nozzles 43 for blowing cleaning liquid (for example, cleaning water) to the insulation post 9 and a rotary brush 44 for brushing the insulation post 9 at the same time with blowing of the cleaning liquid from the shower nozzles 43 to remove deposited paints.

In addition to the blowing of the cleaning liquid to the insulation post 9, another shower nozzles (not illustrated) may be disposed for blowing cleaning liquid to the electrode attachment 2 and, further, a rotary brush (not illustrated may be disposed for brushing both of the right and left sides and the rear side of the electrode attachment 2 as required.

The drying zone D is provided for drying the wetted insulation post 9 so that a high voltage applied to the electrode attachment 2 does not leak by way of the wetted insulation post 9 when the electrode attachment 2 completed with cleaning enters the coating zone T, in which air blowers 45 are disposed for blowing air to both of the electrode attachment 2 and the insulation posts 9.

For shortening the drying time, a hot blow may be blown, and an air blow for blowing a cold blow may be disposed subsequent to the air blower for blowing the hot blow in order to cool the electrode attachment 2 and the insulation post 9 heated by the air blow.

When electrostatic coating is carried out using an aqueous paint by the coating device, the work W is at first carried on the electrode attachment 2 of the conveyor device main body 1 before the coating zone T and transported into the coating zone T.

At this instance, the pick-up coils 8 attached to the slat 3 oppose to the induction rail 6 and generate an induced electromotive force, which is stepped-up by the high voltage generator 7 and a high voltage is applied by way of the electrode attachment 2 to the work W.

Accordingly, electrostatic coating can be carried out using an aqueous paint without applying a high voltage to a coating machine (not illustrated).

In this case, the aqueous paint sprayed from the coating machines disposed on both right and left sides of the conveyor device main body 1 deposits not only on the work W but also on the electrode attachment 2 that carries the work W and on the insulation post 9 that supports the attachment 2.

Then, after the work has passed the coating zone T, since the pick-up coils 8 no more opposes to the induction rail 6, supply of the high voltage applied so far to the electrode attachment 2 is stopped, and the slat 3 runs in the preheat zone P in a state while the paint is deposited on the electrode attachment 2 that carries the work W and on the insulation post 9.

In the preheat zone T, heat is emitted from the IR lamps disposed on the radiation panels 40R, 40L, 40U to the surface of the work W to dry the surface to such an extent as removing an excessive water content contained in coating membranes.

In this case, since the electrode attachment 2 and the insulation post 9 of the conveyor device main body 1 are covered with the heat shield plates 41R, 41L, the paint deposited on the surface is not dried by the heat from the radiation panels 40R, 40L. 40U.

Accordingly, the paint deposited on the electrode attachment 2 and on the insulation post 9 passes the preheat zone in a not yet dried state as it is.

Then, the work W, upon delivery out of the preheat zone, is transferred by the relay device R to the succeeding conveyor that runs in the baking/drying furnace F.

The slat 3 unloaded with the work W retracts by the endless chain 5 to a level below the floor and runs below the floor as far as the coating zone T. Since the paint deposited on the insulation post 9 is still wetted, if the work W is transported as it is to the coating zone T and a high voltage is applied to the electrode attachment 2, a high voltage may possibly leak by way of the paint deposited on the insulation post 9 to the slat 3 as a grounded body.

In view of the above, the paint deposited on the surface of the post 9 is remove by cleaning and dried in the cleaning zone S and the drying zone D formed below the floor.

At first, in the cleaning zone F, cleaning water is sprayed from the shower nozzle 43 to the insulation post 9 and, simultaneously, the insulation post 9 is brushed by the rotary brush 44 to remove the paint deposited on the insulation post 9.

In this case, since the paint deposited on the electrode attachment 2 and on the insulation post 9 is not yet dried in the preheat zone, it can be removed by cleaning relatively easily.

Further, if a shower nozzle for blowing cleaning water to the rear face of the electrode attachment 2 and a rotary brush for brushing the rear side of the electrode attachment 2 are disposed to the cleaning zone S, the paint deposited on the rear side of the electrode attachment 2 can also be cleaned to remove by them.

Then, the slat 3, after passing through the cleaning zone S, is transported to the drying zone D, blown with a hot blow from air blowers 45 disposed on both right and left sides of the conveyor device main body 1 running below the floor, so that the electrode attachment 2 and the insulation post 9 wetted by the cleaning water are dried.

Accordingly, when the electrode attachment 2 advances above the floor and arrives at the coating zone T, since the electrode attachment 2 and the insulation post 9 for mounting and supporting the attachment to the slat 3 are already dried, if a high voltage is applied to the electrode attachment 2, it does not leak to the slat 3 as a body grounded to the earth.

In the cleaning zone S, the shower nozzle 43 and the rotary brush 44 are used together but the present invention is not restricted only thereto, but only the shower nozzle 43 may be disposed and cleaning water may be sprayed from the shower nozzle 43 at a pressure sufficient to remove the paint deposited on the insulation post 9.

Further, in the drying zone D, air is blown from the air blowers 45 to dry the work W, but the present invention is not restricted only thereto but, the work may also be dried by the heat emitted from the radiation heater such as infrared lamps.

As has been described above, according to the present invention, a high voltage generator for supplying a high voltage to an electrode attachment is mounted on each of running bases, and a primary power source for the high voltage generator is supplied to the running base in a contactless fashion only during running of the running base in a high voltage application zone, so that a current collector rail and contacts are no more necessary. In addition, a high voltage applied to the work can be automatically supplied and stopped at a predetermined timing with no circuit on-off operation or without particular voltage control, so that this can provide an excellent effect capable of applying the high voltage to the work transported in the high voltage application zone with no worry of generating sparks.

Further, a conveyor device main body is disposed in adjacent with a coating zone and a preheat zone, so that the work completed with coating can be transported as it is to the preheat zone without transferring to other conveyor, and the excessive water content in coating membranes can be dried to remove instantly to prevent deposition of dusts on the surface, as well as prevent dripping of the coating membranes.

Furthermore, since the conveyor deposited with a paint does not run in a baking/drying furnace, the paint is not baked to the conveyor and since heat shield plates are disposed in the preheat zone so as to cover the electrode attachment and the support post, in the preheat zone, drying for the surface of the coating membranes deposited on the electrode attachment and the support post can surely be prevented, without hindering drying for the surface of the coating layers on the work just after the completion of coating, to enhance the conveyor cleaning performance.

Then, since the conveyor device main body is retracted below the floor and cleaned by water washing with a cleaning device before the paint is baked in a state deposited to the insulation post, the paint deposited on the insulation post can be cleaned to remove extremely simply. Further, since the water content deposited on the insulation post and on the electrode attachment supported by the post is then dried, if it is returned by the endless chain into the coating zone again and a high voltage is applied to the electrode attachment, the high voltage does not leak by way of the insulation post to the slat as a body grounded to the earth.

What is claimed is:

1. A conveyor device for applying a high voltage to a work transported along a predetermined track during transportation in a high voltage application zone formed in a coating booth, wherein a conveyor device main body comprises a running base running along a predetermined track formed in the coating booth and an electrode attachment attached to said running base in an insulated state for carrying a work and applying a high voltage thereto, an electromagnetic wave transmission means is disposed in said coating booth for transmitting electromagnetic waves to said running base during running of said running base in the high voltage application zone in which electrostatic coating is carried out by applying a high voltage to said work, and said running base has, provided therewith, a low voltage generation means for receiving electromagnetic waves transmitted from said electromagnetic transmission means in a contactless fashion and outputting a low voltage, and has, provided therewith, a high voltage generation means for stepping up a low voltage outputted from said low voltage generation means to a predetermined voltage and supplying a high voltage to said electrode attachment.

2. A conveyor device for applying a high voltage to a work transported along a predetermined track during transportation in a high voltage application zone formed in a coating booth, wherein a conveyor device main body comprises a running base running along a predetermined track formed in the coating booth and an electrode attachment attached to said running base in an insulated state for carrying a work and applying a high voltage thereto, an induction rail constituting a primary circuit for electromagnetic induction is disposed in the coating booth for a predetermined length along a work transporting direction in a high voltage application zone for carrying out electrostatic coating by applying a high voltage to said work, and said running base has, provided therewith, pick-up coils constituting a secondary circuit for electromagnetic induction opposing in a contactless fashion to said induction rail and has, mounted therewith, a high voltage generation means for stepping-up a voltage outputted from the pick-up coils by electromagnetic induction relative to said induction rail and supplying a high voltage to said electrode attachment.

3. A conveyor device for applying a high voltage to a work transported along a predetermined track during transportation in a high voltage application zone formed in a coating booth, wherein a conveyor device main body comprises a running base running along a predetermined track formed in the coating booth and an electrode attachment attached to said running base in an insulated state for carrying a work and applying a high voltage thereto, a microwave transmission antenna is disposed in the coating booth for transmitting microwaves to the running base running in the high voltage application zone for carrying out electrostatic coating by applying a high voltage to said work, and said running base has, provided thereon, a microwave receiving antenna for receiving microwaves transmitted from said microwave transmission antenna in a contactless fashion and has, mounted thereon, a high voltage generation means for stepping-up a voltage outputted from said receiving antenna and supplying a high voltage to said electrode attachment.

4. A conveyor device for applying a high voltage to a work transported along a predetermined track during transportation in a high voltage application zone formed in a coating booth, wherein a conveyor device main body comprises a running base running along a predetermined track disposed in the coating booth and an electrode attachment attached to said running base in an insulated state for carrying a work and applying a high voltage thereto, a waveguide tube is disposed in the coating booth along the transporting direction of said work in a high voltage application zone for carrying out electrostatic coating by applying a high voltage on said work, and a microwave oscillator is attached to said waveguide tube for oscillating microwaves, and said running base has, mounted thereon, a microwave receiving antenna inserted in a contactless fashion into a slit formed to said waveguide tube and has, mounted thereon, a high voltage generation means for stepping-up a voltage outputted from said antenna and supplying a high voltage to said electrode attachment.

5. A conveyor device for applying a high voltage to a work transported along a predetermined track during transportation in a high voltage application zone formed in a coating booth, wherein a conveyor device main body comprises a slat conveyor having a slat adapted to run by an endless chain such that the slat advances above the floor of a coating zone and retracts below the floor before a baking/drying furnace and an electrode attachment mounted thereto by way of an insulation post for carrying a work and applying a high voltage thereon, an electromagnetic wave transmission means is disposed in the coating booth for transmitting electromagnetic waves to the slat during running of said slat in the high voltage application zone for carrying out electrostatic coating by applying a high voltage on said work, said slat has, mounted thereon, a low voltage generation means for receiving electromagnetic waves transmitted from said electromagnetic transmission means in a contactless fashion and has, mounted thereon, a high voltage generation means for stepping-up a low voltage outputted from said low voltage generation means to a predetermined voltage and supplying a high voltage to said electrode attachment, and a cleaning device for water washing and cleaning each of insulation posts on both right and left sides thereof and a drying device for drying the insulation posts and the electrode attachment supported thereby completed with water washing and cleaning by said cleaning device are disposed along the advancing direction of said conveyor device main body retracted below the floor.

6. A conveyor device for applying a high voltage to a work transported along a predetermined track during transportation in a high voltage application zone formed in a coating booth, including:

a conveyor device main body comprising a slat conveyor having a slat adapted to run by an endless chain such that the slat advances above a floor of a coating zone and retracts below the floor before a baking/drying furnace, and an electrode attachment mounted on said slat by way of an insulation post, for carrying said work and applying a high voltage thereto, said endless chain being so disposed as to advance above said floor for said coating zone, run in said coating zone and in a preheat zone which includes heaters, and then retract below said floor before the baking/drying furnace, adjacent said preheat zone, an electromagnetic transmission means disposed in said coating zone for transmitting electromagnetic waves to said slat during running of said slat in said high voltage application zone, for carrying out electrostatic coating by applying a high voltage on said work, said slat having, provided thereon, a low voltage generation means for receiving electromagnetic waves transmitted from said electromagnetic wave transmission means in a contactless fashion, and outputting a low voltage and having, provided thereon, a high voltage generation means for stepping-up said low voltage outputted from said low voltage generation means to a predetermined voltage, and supplying a high voltage to said electrode attachment, and heat shield plates disposed in said preheat zone between said conveyor device main body and on both right and left sides thereof, for shielding heat emitted from each of said heaters, with respect to said conveyor device main body.

* * * * *